US007975681B2

(12) United States Patent
Handel

(10) Patent No.: US 7,975,681 B2
(45) Date of Patent: Jul. 12, 2011

(54) SPHERICAL PROJECTILE RELOADING SYSTEM

(76) Inventor: Brandon Handel, Visalia, CA (US)

( * ) Notice: Subject to any disclaimer, the term of this patent is extended or adjusted under 35 U.S.C. 154(b) by 429 days.

(21) Appl. No.: 11/866,891

(22) Filed: Oct. 3, 2007

(65) Prior Publication Data

US 2009/0090343 A1 Apr. 9, 2009

(51) Int. Cl.
*F41B 11/02* (2006.01)

(52) U.S. Cl. ..... 124/49

(58) Field of Classification Search ..... 124/49, 124/51.1, 45

See application file for complete search history.

(56) References Cited

U.S. PATENT DOCUMENTS

| | | | |
|---|---|---|---|
| 5,097,816 | A | 3/1992 | Miller |
| 5,166,457 | A | 11/1992 | Lorenzetti |
| 5,190,196 | A | 3/1993 | Hamer, III |
| 5,505,188 | A | 4/1996 | Williams |
| 5,511,333 | A | 4/1996 | Farrell |
| 5,736,720 | A | 4/1998 | Bell et al. |
| 5,809,983 | A | 9/1998 | Stoneking |
| 5,816,232 | A | 10/1998 | Bell |
| 5,947,100 | A | 9/1999 | Anderson |
| 6,015,058 | A | 1/2000 | Parks |
| 6,055,975 | A | 5/2000 | Gallagher et al. |
| 6,234,157 | B1 | 5/2001 | Parks |
| 6,273,079 | B1 | 8/2001 | Jzn |
| 6,305,367 | B1 | 10/2001 | Kotsiopoulos et al. |
| 6,327,953 | B1 | 12/2001 | Andresen |
| 6,374,819 | B1 | 4/2002 | Ming-Hsien |
| 6,415,781 | B1 | 7/2002 | Perrone |
| 6,418,919 | B1 | 7/2002 | Perrone |
| 6,467,473 | B1 | 10/2002 | Kostiopoulos |
| 6,481,432 | B2 | 11/2002 | Rushton et al. |
| 6,488,019 | B2 | 12/2002 | Kotsiopoulos |
| 6,644,293 | B2 | 11/2003 | Jong |
| 6,644,366 | B2 | 11/2003 | Johnson |
| 6,722,355 | B1 | 4/2004 | Andrews, Jr. |
| 6,729,321 | B2 | 5/2004 | Ho |
| 6,729,497 | B2 | 5/2004 | Rice et al. |
| 6,739,322 | B2 | 5/2004 | Rice et al. |
| 6,739,323 | B2 | 5/2004 | Tippmann, Jr. |
| 6,742,512 | B1 | 6/2004 | Ho et al. |
| 6,915,792 | B1 | 7/2005 | Sheng |
| 6,923,170 | B2 | 8/2005 | Ho et al. |
| 7,000,603 | B1 * | 2/2006 | Steenbeke ..... 124/45 |
| 7,216,641 | B2 * | 5/2007 | Friesen et al. ..... 124/45 |
| 7,270,120 | B2 * | 9/2007 | Broersma et al. ..... 124/51.1 |
| 2002/0059927 | A1 | 5/2002 | Woods, Sr. |

OTHER PUBLICATIONS

Two-page advertisement, http://ricochet.actvil.com.*
Two-page advertisement, http://ricochet.actvil.com [retrieved on Jul. 22, 2010].*

* cited by examiner

*Primary Examiner* — John Ricci
(74) *Attorney, Agent, or Firm* — Robert L. Shaver; Dykas & Shaver LLP

(57) ABSTRACT

A reloading system for dispensing spherical projectiles is disclosed. The reloading system has a removable cartridge that removes from a base unit attached to a spherical projectile device. Upon insertion of the cartridge, a sliding gate on the removable cartridge permits direct feed of the projectiles to the projectile device. An ejection mechanism releases the cartridge for insertion of another cartridge.

11 Claims, 3 Drawing Sheets

SPHERICAL PROJECTILE RELOADING SYSTEM

FIELD OF THE INVENTION

The present invention generally relates to quick reloading systems for round projectiles and more particularly to the quick reloading systems for paintball markers.

BACKGROUND OF THE INVENTION

In many different situations, luck is simply opportunity meeting preparation. In paintball, opportunities are created when your opposing force becomes vulnerable. Preparation is reducing your own vulnerabilities and defining tactics and strategies that reduce the probability of the opponent taking advantage of your vulnerabilities.

In the game of paintball, players may fire several hundred paintballs in a matter of minutes. Covering avenues of egress effectively so as to dissuade opposing teammates from attack may require a consistent barrage of paintballs. The amount of this type of coverage is limited by the amount of paintballs available to the player. In some settings, a large hopper may provide an adequate supply but the larger hopper increases the target profile for the opposing force. A smaller hopper reduces the user's target profile but limits the number of paintballs a player has available to his or her disposal. The capacity of any system can be increased by using an external cartridge to reload the base unit with additional paintballs. The use of cartridges allows the user to gain the benefit of a decreased target profile while still maintaining the high volume of coverage.

In utilizing the base unit-cartridge combination, the depleted base unit must be refreshed with additional paintballs. First, both the base unit to be refilled and the cartridge holding fresh paintballs must be opened, which generally consists of opening a lid to both units. Next, the contents of the cartridge are dumped into the base unit. Finally, the lid to the base unit is closed and the depleted cartridge is discarded for collection after the game is completed. This process may be repeated numerous times throughout the course of a game. If the game consists of several rounds, the cartridges may be refilled in between rounds for continued use. Reloading the base unit provides the user with additional paintballs but also makes the user vulnerable to attack during the refilling process.

During reloading, the user's resources must be divided between the game and the reloading process. First, the reloading process may require the use of two hands to open the hopper and cartridge. Second, the user must partially divert his or her attention away from the game to the reloading process. A user who focuses too much on the reloading process may open himself or herself to attacks from other players while players focusing too much on the game may spill and waste a significant portion of their paintballs thereby increasing the frequency of reloading sessions. Depending on the complexity of the system, problems may also arise from components in the system failing. Increasing the complexity of the system increases the probability of component failure. Third, the time it takes to refill the hopper is also time that an avenue of egress remains uncovered by suppression fire. The player is also left effectively defenseless; opposing forces may capitalize on this time and make significant advances. Furthermore, the use of a hopper with a lid requires that the user ensure that the lid is closed before engaging in high-intensity activities. Failure to properly close the hopper may result in paintballs falling out of the hopper thereby decreasing the number of balls available for attack. Therefore there is a need for a quick, simple device to provide paintballs to a paintball marker that requires a minimum of interaction between the player and the paintball marker and that does not require a lid.

SUMMARY OF THE INVENTION

According to the present invention, the foregoing advantages and objects are obtained by a base unit attached to a spherical projectile propulsion device that is connected to the feed tube of the spherical projectile marker. A base unit is a generally-static attachment to the spherical projectile marker. A spherical projectile marker can be any number of devices that propel spherical objects by pneumatic or mechanical means including, but not limited to, markers used in paintball, airsoft, or law enforcement. Attached to the base unit is a removable cartridge that holds the projectiles to be used. The cartridge is tubular and has a sliding gate. The removable cartridge also holds several paintballs. The cartridge delivers the projectiles to the base unit by gravity feed. The sliding gate keeps the projectiles within the cartridge until the cartridge is connected to the base unit. The cartridge can be replaced easily and rapidly by simply removing the cartridge and replacing it with a new one. The sliding gate that is attached to the cartridge will move open when the cartridge is inserted into the base unit and then will move to close when the cartridge is removed from the base unit.

In one preferred embodiment of the device, the removable cartridge is generally cylindrical so as to allow the user to quickly insert the cartridge without needing to align the cartridge along the axis of the base unit. The user simply inserts the cartridge into the base unit by aligning the axis of the cylinder with the axis of the opening to the base unit. By using a cylindrical cartridge, the user can quickly load and re-load the base unit using less attention than a system that requires the user to align the cartridge before attaching to the base unit.

In another embodiment of the current device, the base unit latches onto a flange located on the cartridge. The flange may circumvolve the cartridge and provides a positive lock of the cartridge and the base unit. Other embodiments may include an ejection mechanism such a spring for allowing the cartridge to be discharged from the base unit with a simple push of a button. The button is pushed, which releases the latch mechanism. A spring, or other device, forces the cartridge from the base unit.

The purpose of the foregoing summary is to enable the public, and especially the scientists, engineers, and practitioners in the art who are not familiar with patent or legal terms or phraseology, to determine quickly from a cursory inspection, the nature and essence of the technical disclosure of the application. The summary is neither intended to define the invention of the application, which is measured by the claims, nor is it intended to be limiting as to the scope of the invention in any way.

Still other features and advantages of the present invention will become readily apparent to those skilled in this art from the following detailed description describing preferred embodiments of the invention, simply by way of illustration of the best mode contemplated by carrying out my invention. As will be realized, the invention is capable of modification in various obvious respects all without departing from the invention. Accordingly, the drawings and description of the preferred embodiments are to be regarded as illustrative in nature, and not as restrictive in nature.

DESCRIPTION OF THE PREFERRED EMBODIMENTS

Figure 1:
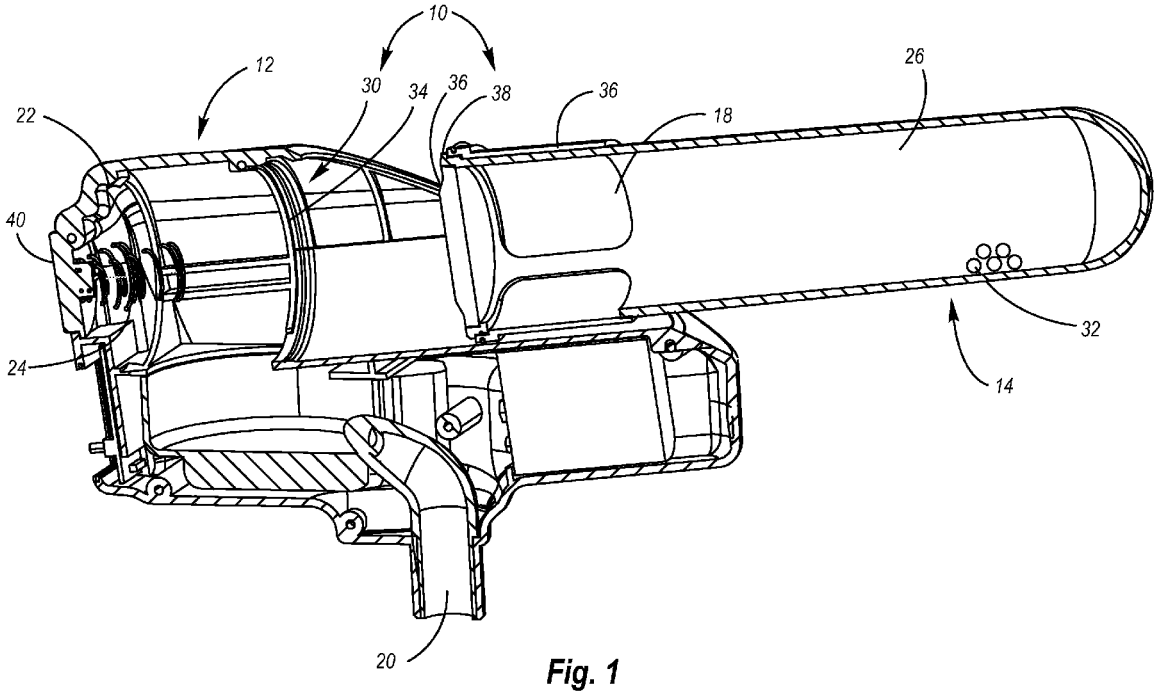
FIG. 1 is a cross sectional view of the base unit and the cartridge.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

In the following description and in the figures, like elements are identified with like reference numerals. The use of "or" indicates a non-exclusive alternative without limitation unless otherwise noted. The use of "including" means "including, but not limited to," unless otherwise noted.

Figure 3:
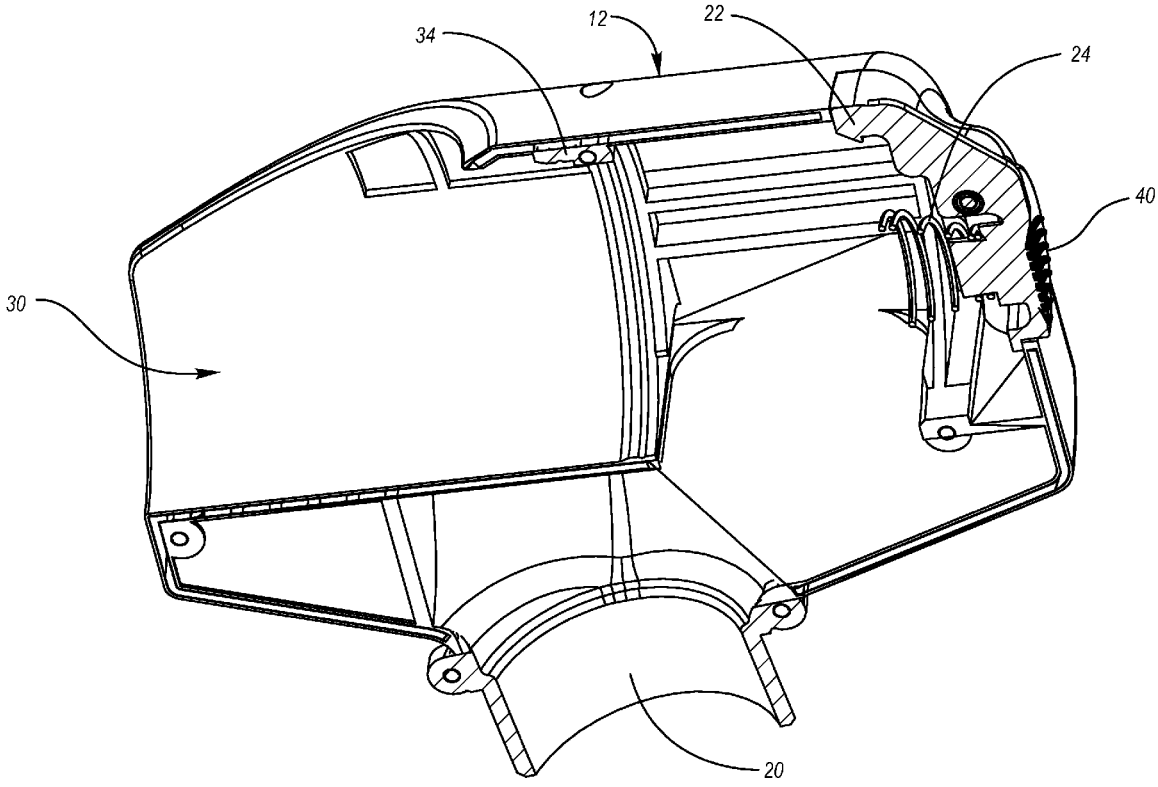
FIG. 3 is a cross sectional view of an alternative embodiment of the base unit.

FIG. 1 and FIG. 3 show a cross sectional view of the quick loading propulsion device 10, which comprises a base unit 12 attached to a projectile propulsion device through base unit conduit 20 and a cartridge 14 that is removably attached to the base unit 12. Base unit conduit 20 allows for spherical projectiles 32 to flow into a projectile propulsion device. The base unit 12 is configured to receive cartridge 14 by base unit cartridge opening 30 but only allows passage of spherical projectiles 32. Projectile cartridge chamber 26 is configured to securely hold spherical projectiles 32 until dispersed into base unit 10. Located inside cartridge projectile chamber 26 are spherical projectiles 32. Ideally, cartridge 14 is dimensioned to fit with existing paintball accessories, such as guppy (pod) vests and belts.

Figure 2:
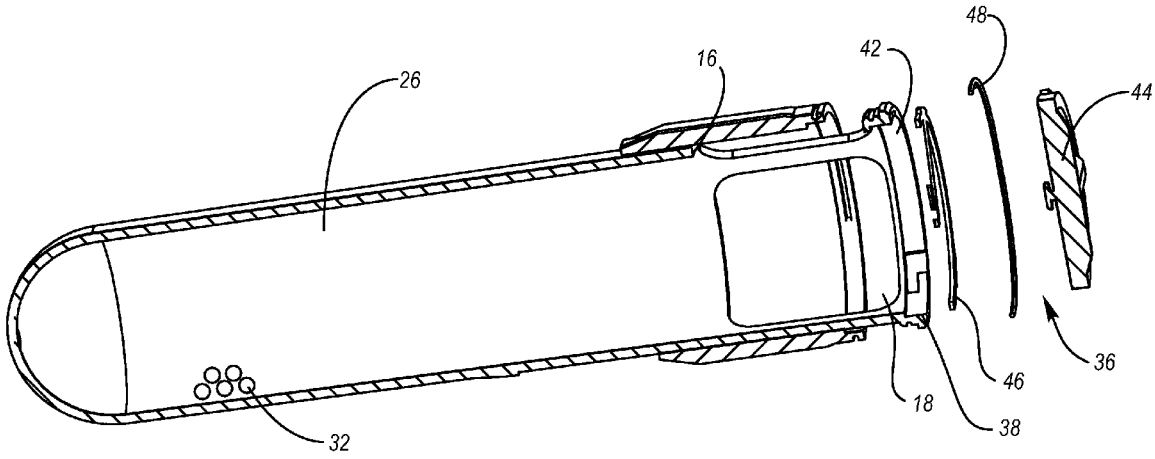
FIG. 2 is a cross sectional blow up view of the cartridge

FIG. 2 is an exploded cross sectional view of a cartridge 14. In the preferred embodiment, sliding gate 16 circumvolves cartridge projectile opening 18 and is configured to move towards the anterior of cartridge 14. When in storage or disconnected from base unit 12, sliding gate 16 covers cartridge projectile opening 18 forming a tight closure. Sliding gate 16 is held in place by spring 48. Spring 48 provides tension that must be overcome during insertion into base unit 12. In a typical arrangement, the user will have several cartridges, and only one base unit, to change a depleted cartridge for a reloaded one during the course of an game. Upon initial insertion of cartridge 14 into base unit cartridge opening 30, sliding gate 16 abuts sliding gate opening mechanism 34, pushing sliding gate 16 towards the posterior of cartridge 14. Applying further pressure onto cartridge 14 further exposes cartridge projectile opening 18 thereby allowing spherical projectiles 32 to flow to base unit conduit 20 for direct delivery to projectile propulsion device. Latch mechanism interfaces with anterior cartridge flange 38 providing positive attachment of cartridge 14 to base unit 12. Ejection spring 24 operatively contacts anterior cartridge surface 36, storing compressive force. When cartridge 14 becomes depleted of spherical projectiles 32, the cartridge may be ejected by applying force to ejection button 40 thereby detaching latch mechanism 22 from contact with anterior cartridge flange 38 and allowing ejection spring 24 to forcefully push cartridge 14 through base unit cartridge opening 30.

In one embodiment, anterior cartridge surface 36 has a cartridge refill opening 42. In order to fill cartridge 14 with spherical projectiles 32, cartridge refill closure 44 is removed allowing spherical projectiles 32 to be inserted into cartridge 14. Cartridge refill closure lanyard 46 positively locates cartridge refill closure 44 and discourages cartridge refill closure 44 from becoming misplaced.

The exemplary embodiments shown in the figures and described above illustrate but do not limit the invention. It should be understood that there is no intention to limit the invention to the specific form disclosed; rather, the invention is to cover all modifications, alternative constructions, and equivalents falling within the spirit and scope of the invention as defined in the claims. For example, while the exemplary embodiments illustrate a reloading system for a paintball marker the invention is not limited to use with paintball markers and may be used with other devices that dispense spherical projectiles such as airsoft guns or spherical pepperspray pellets. While the invention is not limited to use with paintballs, it is expected that various embodiments of the invention will be particularly useful in such devices. Hence, the foregoing description should not be construed to limit the scope of the invention, which is defined in the following claims.

While there is shown and described the present preferred embodiment of the invention, it is to be distinctly understood that this invention is not limited thereto, but may be variously embodied to practice within the scope of the following claims. From the foregoing description, it will be apparent that various changes may be made without departing from the spirit and scope of the invention as defined by the following claims.

What is claimed is:

1. A quick change loader for dispensing spherical projectiles into a projectile propulsion device with a feed tube, the loader comprising;

a base unit attached to said projectile propulsion device and in communication with said feed tube of said projectile device;

a tubular cartridge circular in cross section with both ends closed, for holding said projectiles, said cartridge removably attachable to said base unit by a latch on said base unit, with said cartridge comprising at least one projectile opening on a side of said cartridge for gravity delivery of said projectiles to said base unit, with said at least one projectile opening covered by a sliding gate; wherein said sliding gate is configured to fully circumvolve said tubular cartridge and to open by moving toward the posterior of said cartridge to expose said at least one projectile opening when said cartridge is attached to said base unit, to allow gravity delivery of said projectiles when said cartridge is attached to said base unit.

2. The quick change loader of claim 1 wherein said cartridge further comprises at least one retaining feature to interact with said latch to inhibit undirected removal of said cartridge from said base unit.

3. The quick change loader of claim 2 wherein said retaining features comprises at least one radially extending flange.

4. The quick change loader of claim 1 wherein said sliding gate is spring loaded.

5. The quick change loader of claim 1 wherein said base unit further comprises at least one projection for opening said sliding gate.

6. A quick change loader for dispensing paintballs into a paintball marker, the loader comprising;

a base unit attached to said paintball maker and in communication with a feed tube of said paintball marker;

a tubular cartridge with a along axis and a generally cylindrical cross section with both ends closed for holding said paintballs, removably attachable to said base unit, configured for attachment to said base unit by a latch on said base unit, with said cartridge comprising at least one paintball opening on a side of said cartridge, for gravity delivery of said paintballs to said base unit, with said at least one paintball opening covered by a sliding gate; wherein said sliding gate fully circumvolves said cartridge and is configured to move toward said top end of said cartridge, away from said base unit to expose said at least one paintball opening when said cartridge is attachable to said base unit, and configured for attachment to said base unit with said cartridge at any angle around said long axis to allow gravity delivery of said paintballs to said paintball marker when said cartridge is attached to said base unit.

7. The quick change loader of claim 6 wherein said cartridge further comprises at least one retaining feature to interact with said latch to inhibit undirected removal of said cartridge from said base unit.

8. The quick change loader of claim 6 wherein said retaining features comprises at least one radially extending flange.

9. The quick change loader of claim 6 wherein said sliding gate is spring loaded.

10. The quick change loader of claim 6 wherein said base unit further comprises at least one projection for opening said sliding gate when said cartridge is attached to said base unit.

11. A quick change loader for dispensing spherical projectiles into a projectile propulsion device with a feed tube, the loader comprising;

a base unit attached to said projectile propulsion device and in communication with said feed tube of said projectile device;

a cylindrical cartridge with both ends closed, and the bottom end openable for refilling said cartridge, said cartridge for holding said projectiles and configured for removable attachment to said base unit, configured for attachment to said base unit with said cartridge at any angle around the long axis of the cylindrical cartridge and to attach to said base unit by a latch on said base unit, said latch configured to interface with a radially extending flange on said cylindrical cartridge, said cartridge comprising at least one projectile opening on a side of said cartridge for gravity delivery of said projectiles to said base unit, said at least one projectile opening covered by a sliding gate which fully circumvolves said cartridge; wherein said sliding gate is biased by a spring and configured to move toward said top end of said cartridge to expose said at least one projectile opening when said cartridge is attached to said base unit, to allow gravity delivery of said projectiles when said cartridge is attached to said base unit.

* * * * *